US011485394B2

(12) United States Patent
Ravi et al.

(10) Patent No.: US 11,485,394 B2
(45) Date of Patent: Nov. 1, 2022

(54) VEHICLE FLASHOVER DETECTION SYSTEM

(71) Applicant: General Electric Company, Schenectady, NY (US)

(72) Inventors: Premsunder Ravi, Chennai (IN); Chandra Mouleswar Reddy S., Hyderabad (IN); Munishwar Ahuja, Bangalore (IN); Shankar Chandrasekaran, Eric, PA (US); Bret Worden, Erie, PA (US)

(73) Assignee: TRANSPORTATION IP HOLDINGS, LLC, Norwalk, CT (US)

( * ) Notice: Subject to any disclaimer, the term of this patent is extended or adjusted under 35 U.S.C. 154(b) by 584 days.

(21) Appl. No.: 16/199,464

(22) Filed: Nov. 26, 2018

(65) Prior Publication Data

US 2019/0193759 A1 Jun. 27, 2019

Related U.S. Application Data

(60) Provisional application No. 62/608,594, filed on Dec. 21, 2017.

(51) Int. Cl.
*B61L 3/00* (2006.01)
*G07C 5/08* (2006.01)
(Continued)

(52) U.S. Cl.
CPC ..... *B61L 3/006* (2013.01); *B61L 15/0081* (2013.01); *B61L 27/57* (2022.01); *G07C 5/085* (2013.01);
(Continued)

(58) Field of Classification Search
CPC ..... B61L 3/006; B61L 27/57
See application file for complete search history.

(56) References Cited

U.S. PATENT DOCUMENTS 4,112,475 A * 9/1978 Stitt ..... H02H 7/0811 361/33
6,507,797 B1 * 1/2003 Kliman ..... G01R 31/343 702/75
(Continued)

*Primary Examiner* — Jess Whittington
(74) *Attorney, Agent, or Firm* — The Small Patent Law Group LLC; Mary D. Lawlor

(57) ABSTRACT

A locomotive control system includes a locomotive having a traction motor and sensors. The traction motor provides tractive effort for propelling the locomotive and the sensors measure performance conditions of the locomotive. The system also includes a controller having one or more processors communicatively coupled with the traction motor. The controller selects one or more baseline conditions that designate operational conditions under which the locomotive is to operate, and monitors the performance conditions that are generated by the locomotive during operation of the locomotive according to the operational conditions designated by the one or more baseline conditions. The controller identifies a flashover condition or a plugging condition of the locomotive by comparing the performance conditions that are generated by the locomotive during operation of the locomotive with the one or more baseline conditions. The flashover condition or the plugging condition causing degradation of one or more components of the locomotive.

17 Claims, 9 Drawing Sheets

(51) Int. Cl.
*B61L 15/00* (2006.01)
*B61L 27/57* (2022.01)

(52) U.S. Cl.
CPC ..... *G07C 5/0808* (2013.01); *G07C 5/0841* (2013.01)

(56) References Cited

U.S. PATENT DOCUMENTS 6,927,597 B2 * 8/2005 Kliman ..... G01R 31/343 324/76.19
9,233,696 B2 * 1/2016 Kumar ..... B61L 27/40
10,053,236 B1 * 8/2018 Buchmueller ..... G06K 9/6201
11,231,705 B2 * 1/2022 Cella ..... G06K 9/6262
2003/0041946 A1 * 3/2003 Fogal, Sr. ..... B60C 19/003 156/75
2006/0131464 A1 * 6/2006 Hesser ..... B61K 9/06 246/169 D
2009/0248226 A1 * 10/2009 Kellner ..... B61L 15/0018 701/19
2010/0023190 A1 * 1/2010 Kumar ..... B61L 27/40 701/20
2013/0158894 A1 * 6/2013 Lee ..... G01M 17/10 702/34
2014/0330604 A1 * 11/2014 Connolly ..... G06Q 10/06316 705/7.15
2015/0193992 A1 * 7/2015 Kumar ..... B61K 9/12 701/29.2
2017/0084094 A1 * 3/2017 Worden ..... G07C 5/0808
2017/0254727 A1 * 9/2017 Zoken ..... G01B 11/24
2017/0336293 A1 * 11/2017 Kondo ..... G01M 17/10
2018/0240290 A1 * 8/2018 Kumar ..... G06Q 10/20
2018/0276911 A1 * 9/2018 Mcafee ..... G07C 5/08
2019/0028903 A1 * 1/2019 Carpenter ..... G08G 5/006

* cited by examiner

VEHICLE FLASHOVER DETECTION SYSTEM

CROSS-REFERENCE TO RELATED APPLICATIONS

This application claims priority to U.S. Provisional Application No. 62/608,594, which was filed on Dec. 21, 2017, and the entire disclosure of which is incorporated herein by reference.

FIELD

Embodiments of the inventive subject matter described herein relate to systems that control vehicles such as locomotives based on evaluated health of the vehicles and/or components of the vehicles.

BACKGROUND

Vehicles such as rail vehicles, automobiles, marine vessels, and the like, are complex systems having many interconnected components and assemblies. Over time, different components and assemblies can wear and degrade. This can negatively impact operation of the vehicle and/or other components and assemblies.

Severe degradation and wear can result in significant costs in both labor, downtime, and replacement parts. While some known systems and methods can attempt to predict when repair or replacement of components is needed, these systems and methods may lack in accuracy of predictions and/or identify the need for repair or replacement at too late of a time.

BRIEF DESCRIPTION

In one embodiment, a locomotive control system includes a locomotive having a traction motor and one or more sensors. The traction motor provides tractive effort for propelling the locomotive. The one or more sensors measure one or more performance conditions of the locomotive. The locomotive control system also includes a controller having one or more processors communicatively coupled with the traction motor. The controller selects one or more baseline conditions that designate operational conditions under which the locomotive is to operate. The controller also monitors the one or more performance conditions that are generated by the locomotive during operation of the locomotive according to the operational conditions designated by the one or more baseline conditions. The controller is configured to identify one or more of a flashover condition or a plugging condition of the locomotive by comparing the performance conditions that are generated by the locomotive during operation of the locomotive with the one or more baseline conditions. The flashover condition or the plugging condition causing degradation of one or more components of the locomotive.

In one embodiment, a locomotive control system includes a locomotive having a traction motor, a wheel, and one or more sensors. The traction motor provides tractive effort for propelling the locomotive. The one or more sensors measure one or more performance conditions of the wheel. The locomotive control system also includes a controller having one or more processors communicatively coupled with the traction motor. The controller selects one or more baseline conditions of the wheel that designate operational conditions under which the wheel is to operate. The controller also monitors the one or more performance conditions of the wheel generated by the wheel measured by the one or more sensors. The performance conditions are generated by the wheel during operation of the locomotive according to the operational conditions designated by the one or more baseline conditions. The controller is configured to identify a degraded wheel of the locomotive by comparing the performance conditions that are generated by the wheel during operation of the locomotive with the one or more baseline conditions.

In one embodiment, a locomotive control system includes a locomotive having a traction motor and one or more sensors. The traction motor provides tractive effort for propelling the locomotive. The one or more sensors measure one or more performance conditions of the locomotive. The locomotive control system also includes a controller having one or more processors communicatively coupled with the traction motor. The controller selects one or more baseline conditions that designate operational conditions under which the locomotive is to operate. The controller also monitors the one or more performance conditions that are generated by the locomotive during operation of the locomotive according to the operational conditions designated by the one or more baseline conditions. The controlled is configured to identify one or more of a flashover condition or a plugging condition of the locomotive by determining a variance in the performance conditions that are generated by the locomotive during operation of the locomotive exceeds one or more designated thresholds. The flashover condition or the plugging condition causing degradation of the one or more components of the locomotive.

BRIEF DESCRIPTION OF THE DRAWINGS

Reference is now made briefly to the accompanying drawings, in which.

DETAILED DESCRIPTION

Figure 1:
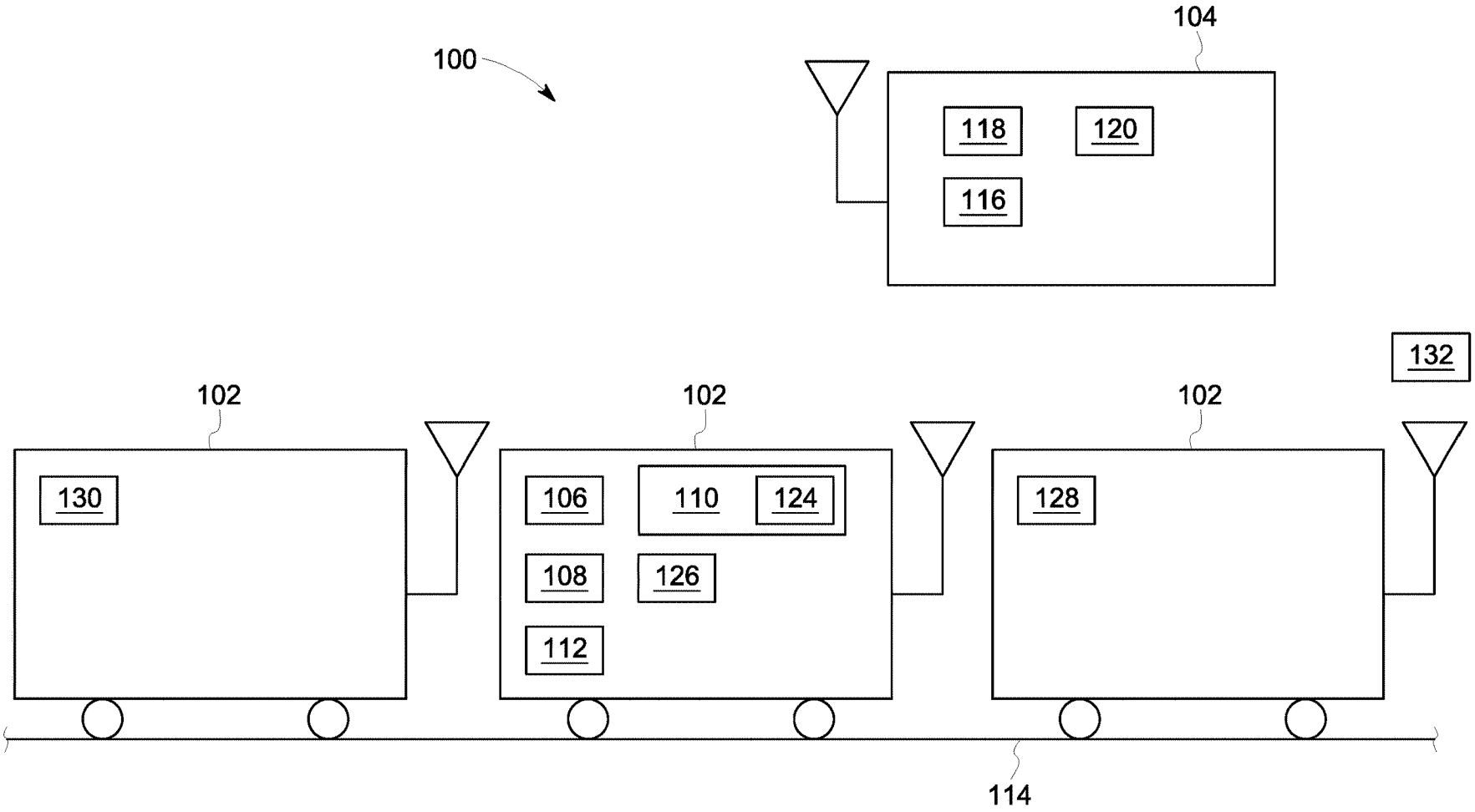
FIG. 1 schematically illustrates an example of a vehicle system.

Reference will be made below in detail to example embodiments of the inventive subject matter, examples of which are illustrated in the accompanying drawings. Wherever possible, the same reference numerals used throughout the drawings refer to the same or like parts. Although example embodiments of the inventive subject matter are described with respect to locomotives or rail vehicles, embodiments of the inventive subject matter are also applicable for use with other vehicles. For example, the vehicles may be off-highway vehicles designed to perform an operation associated with a particular industry, such as mining, construction, farming, etc., and may include haul trucks, cranes, earth moving machines, mining machines, farming equipment, tractors, material handling equipment, earth moving equipment, etc. Optionally, the vehicles may be on-road vehicles, such as automobiles, tractor-trailer rigs, on-road dump trucks, etc. Moreover, yet other embodiments of the inventive subject matter are applicable to purely electric vehicles and machinery, such as battery powered vehicles.

One or more embodiments of the inventive subject matter described herein provides methods and systems that monitor operation of a locomotive or more components of the locomotive and that identify a flashover condition or a plugging condition of the locomotive. At least one technical effect of the inventive subject matter described herein includes identifying the flashover condition and implementing a responsive action (e.g., replacing or repairing a degraded component, slowing or stopping movement of the vehicle, or the like) prior to a flashover occurring. For example, sporadic or continuous wheel vibrations may cause a flashover to occur which may cause components of a direct current (DC) electric traction motor to degrade (e.g., commutators, brushes, brush holders, brush pigtails, cables, windings, or the like).

Additionally, at least one technical effect of the inventive subject matter described herein includes identifying the plugging condition and implementing a responsive action (e.g., slowing or stopping movement of the vehicle, delaying engagement of a vehicle reverser handle, repairing or replacing a degraded component) in order to improve the prevention of a plugging operation. For example, a sporadic or continuous reversal of motor polarity may cause a plugging operation to occur which may cause components of the DC traction motor to degrade (e.g., commutators, brushes, windings, or the like).

One embodiment of the inventive subject matter described herein examines data from previously existing sensors or sensor readings and correlates this data to specific components of the vehicle. The sensors may be pre-existing in that the sensors (or the data that is output by the sensors) are used for one or more purposes other than evaluation of the health of the vehicle or vehicle component. For example, the sensor or sensor data may be used for control of the vehicle. The systems and methods described herein can use this sensor data to evaluate the health of the vehicle or vehicle component without physical inspection of the component. The extent of damage, abnormality, degradation, or other change in the component can be identified from this sensor data.

Using one or more embodiments of the inventive subject matter described herein, a baseline condition of a locomotive is selected with one or more controllers. During normal operation of the vehicle with predefined test cases, the performance of the vehicle or one or more components of the vehicle can be monitored on a continuous or a defined interval basis. Measuring parameters (e.g., displacement, speed, acceleration, etc.) from existing sensors (e.g., a speed sensor) or with special sensors (e.g., a three-axis accelerometer) can allow for the health of various vehicle components to be evaluated. From the measured parameters, evaluating frequency responses, natural frequency components, damping, rise times, settling times, absolute/RMS/average magnitude, mean/standard deviation, or any other such quantity can be determined to identify a flashover condition of the vehicle or to identify one or more degraded components of the vehicle. An unhealthy or damaged condition of a vehicle component can be evaluated by examining the performance of the components to identify deviations in the performance over time or by identifying the difference from a component performance from a predefined or designated healthy baseline condition.

FIG. 1 schematically illustrates one example of a vehicle system 100 in accordance with one embodiment. The vehicle system 100 may be formed from a single vehicle 102, or two or more vehicles traveling together along a route 114. While the vehicle and route are indicated in FIG. 1 as being a locomotive and a track, respectively, not all embodiments of the subject matter described herein are limited to rail vehicles. One or more embodiments can be used with automobiles, off-highway vehicles, or the like.

A communication system 104 is disposed off-board the vehicle system 100 and is communicatively coupled with the vehicle system 100. The communication system 104 may also be referred to herein as a data-center, a control center, a dispatch tower, or the like, that may be at a location that is within view of the vehicle system 100, at a location about 50 kilometers away from the vehicle system 100, at a location about 500 kilometers away from the vehicle system 100, at a location about 5000 kilometers away from the vehicle system, or the like.

The communication system 104 wirelessly communicates with the one or more vehicles 102 of the vehicle system 100. Additionally, the communication system 104 may include several devices (also referred to as components), that may communicate with each other and/or among each other according to one embodiment. For example, the devices may include a power unit 120, communications unit 116, an off-board controller 118, or the like. The off-board controller 118 may also be referred to herein as an energy management system 118, and may perform a number of functions for the communication system 104. For example, the off-board controller 118 may determine an estimated trip load, determine an amount of available energy of the power unit 120, may transmit a request signal via the communications unit 116 to the vehicle system 100, or the like.

The communication system 104 communicates data between various devices that may be onboard and/or off-board the vehicle system 100. The communication system 104 can receive data signals (e.g., wireless data signals) from off-board wayside devices, such as roadside transponders, signals, sensor systems (e.g., hotbox detectors), sensing devices, positive train control transponders, or the like. The off-board communication system 104 may receive data signals from other off-board devices, such as satellites, wireless devices (e.g., cellular phones, computers, remote controls, or the like.), a dispatch tower, or other locations or devices.

The devices shown onboard vehicle 102 may be disposed onboard a single vehicle 102 of the vehicle system 100 or optionally may be distributed among two or more vehicles 102 of the vehicle system 100. Different devices onboard the vehicle 102 may communicate with and/or among each other to control operations of the vehicle system 100. For example, devices onboard the vehicle system 100 may communicate with each other to control tractive efforts produced by the vehicle system 100. Additionally or alternatively, the devices onboard the vehicle system 100 may communicate with each other to control braking efforts produced by the vehicle system 100. Optionally, the devices onboard the vehicle system 100 may also communicate with each other to display information from one or more components onboard one vehicle 102 on a display device on the same or different vehicles 102.

An energy management system 106 ("EMS") is a device onboard the vehicle system 100. Alternatively, the EMS 106 may be off-board the vehicle system. The EMS 106 may determine a trip plan to be used in controlling movement of vehicle system 100. The trip plan may also be communicated from the communication system 104 or from any alternative off-board system. The trip plan includes designated operational settings of the vehicle system 100 to dictate how the vehicle system 100 is to travel along the route 114. For example, the designated operational settings may be based on the designated grades of the route, governmental or organizational restrictions (e.g., speed limits, emissions limitations, or the like), the time and day of travel, or the like. The designated operational settings may include designated power settings, acceleration settings, designated speeds, velocity settings, throttle settings, brake settings, or the like, that control the vehicle system 100 as the vehicle system travels along the route 114. In one or more embodiments, the operational settings of the trip plan may be designated as a function of time and/or distance of the route based on the designated grades of the route. Benefits of the vehicle system 100 traveling according to the designated operational settings of the trip plan include reduced fuel consumption, reduced emissions generation by the vehicle system, improved handling of the vehicle system, the vehicle system arriving at a designated location within a designated time period and/or at a designated time, control of vehicle speed settings according to speed limits, or the like, relative to the same vehicle system 100 traveling along the same route 114 for the same trip according to different operational settings (e.g., traveling at the track speed or other speed limit of the route 114).

The vehicle system 100 also includes a locomotive control system 110 of the vehicle 102 having a controller 124 that controls operations of the vehicle 102 and/or vehicle system 100. The locomotive control system 110 represents hardware circuitry that includes and/or is connected with one or more processors (e.g., microprocessors, controllers, field programmable gate arrays, integrated circuits, or the like). The locomotive control system 110 can generate signals that are communicated to a propulsion system 112 of the vehicle 102 (e.g., including direct current (DC) traction motors, alternating current (AC) traction motors, alternators, generators, etc.), or to any other systems. The locomotive control system 110 can include one or more input and/or output devices such as keyboard, an electronic mouse, stylus, microphone, touchscreen, other display screen, or the like, for communicating with an operator of the vehicle 102 or vehicle system 100. The locomotive control system 110 is operably connected with components of the off-board communication system 104. Additionally or alternatively, the locomotive control system 110 is operably connected with components that are disposed onboard the vehicle 102, onboard other vehicles of the vehicle system 100, and/or off-board the vehicle system 100, to control operation of the vehicle system 102. For example, the locomotive control system 110 may receive instructions from the energy management system 106 that dictate how the vehicle system 100 is to move at different locations during a trip.

One or more sensors or sensing devices 126, 128, 130, 132 may be operably coupled with one or more of the vehicles 102, disposed off-board the vehicle system 100, disposed onboard the vehicle system 100, or the like. The sensors 126-132 may be configured to obtain, collect, sense, measure, or the like, sensing data of the vehicle 102, one or more components of the vehicle 102, one or more systems of the vehicle 102 (e.g., the propulsion system, the locomotive control system, the energy management system, or the like), the vehicle system 100, the track or the route 114, or the like. The one or more sensors 126-132 may include, but are not limited to, accelerometers, still image or video camera sensors, pressure sensors, strain gages, acoustic sensors, global positioning system sensors, speed sensors, integrated sensing systems combining one or more therein, or the like. During normal operation of predefined test cases of the vehicle system 100, the performance of the vehicle 102 and/or one or more components of the vehicle system 100 can be monitored on a continuous or defined interval basis, for example by one or more of the sensors 126-132. Measuring parameters from the sensors may including displacement, vibrations, speed, pressure, acceleration, geometry, or the like.

One embodiment of the inventive subject matter described herein examines data from previously existing sensors, sensing systems, or sensor readings and correlates this data to specific components of the vehicle 102 and/or the vehicle system 100. The sensors may be pre-exiting in that the sensors (or the data that is output by the sensors) are used for one or more purposes other than evaluation of the health of the vehicle 102 of one or more vehicle components. For example, the sensor or sensor data may be used for control of the vehicle 102. Additionally, the sensor data may be used to evaluate the health of the vehicle 102 and/or the health of the vehicle components without physical inspection of the component. The extent of damage, abnormality, degradation, or other changes in the component can be identified from this sensor data.

In one or more embodiments, the controller 124, the off-board controller 118, and/or one or more alternative hardware controllers may operate to control one or more operations of the vehicle 102 and/or the vehicle system 100. For example, one or more of the controllers 124, 118 may select one or more baseline conditions that designate operational conditions under which the vehicle 102 and/or the vehicle system 100 is to operate. For example, the baseline conditions may be selected autonomously by the onboard and/or off-board controllers 124, 118, or may be selected manually by an operator of the onboard and/or off-board controllers 124, 118. In one example, the baseline condition may be a designated wheel condition including wheel shape, size, profile, magnitude of vibrations, wheel impact forces, or the like. The baseline designated wheel condition designates operational conditions under which the wheels of the vehicle system 100 are to operate when the vehicle system 100 is operating. For example, the off-board controller 118 may select the baseline designated wheel conditions that designate how the wheels are to operate when the vehicle is operating. Optionally, an operator onboard the vehicle system 100, an operator off-board the vehicle system 100, or the like, may select the baseline conditions that designate the operational conditions under which the vehicle 102 is to operator by manually controlling the settings of the control system 110.

Figure 2A:
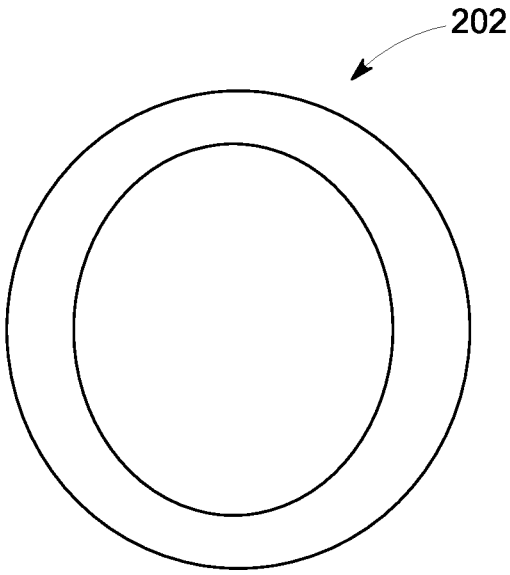
FIG. 2A illustrates an example of a healthy wheel of the vehicle system shown in FIG. 1.
Figure 2B:
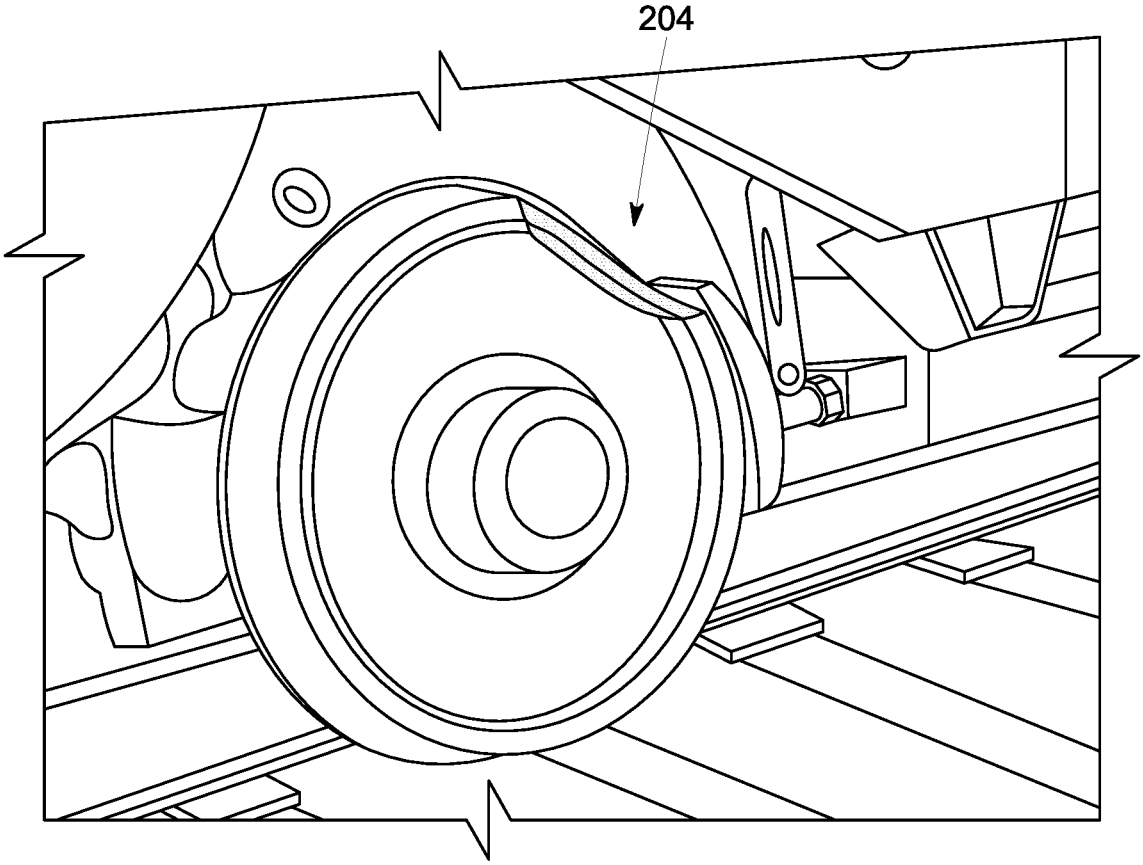
FIG. 2B illustrates an example of a degraded wheel of the vehicle system shown in FIG. 1.

FIG. 2A illustrates an example of a healthy wheel 202 of the vehicle system 100 in accordance with one embodiment. For example, the healthy wheel 202 is shaped, sized, and operates according to the baseline designated wheel conditions selected by the locomotive control system 110. Alternatively, FIG. 2B illustrates an example of a degraded wheel 204 of the vehicle system 100 in accordance with one embodiment. The degraded wheel 204 is not shaped, sized, and does not operate according to the baseline designated wheel conditions selected by the locomotive control system 110. For example, the degraded wheel 204 has a performance condition (e.g., performs differently) that differs from the baseline wheel condition of the healthy wheel 202 that designates the operational conditions under which the wheel is to operate. In the illustrated embodiment, the degraded wheel 204 induces vibrations (e.g., vertical vibrations, lateral vibrations, or the like) as the degraded wheel 204 rotates about the wheel axle that are greater (e.g., have a higher magnitude) relative to vertical vibrations induced by the healthy wheel 202 as the healthy wheel 202 rotates about the wheel axle. Additionally or alternatively, the degraded wheel 204 may include any alternative degradation including but not limited to, shape, size, wear, or the like, that may induce vibrations, impact forces, track misalignment, or the like, that differ from vibrations, impact forces, track alignment, or the like of a healthy wheel 202 that operates according to the baseline wheel conditions.

In the illustrated embodiment of FIG. 2B, the degraded wheel 204 induces vibrations that differ from vibrations induced by the healthy wheel 202. Additionally, the vibrations induced by the degraded wheel 204 may cause one or more components of the vehicle 102 to degrade, fail, or the like. For example, the greater magnitude vibrations of the degraded wheel 204 relative to the vibrations of the healthy wheel 202 may induce arcing between a brush and commutator interface of a direct current (DC) traction motor of the propulsion system 112. Additionally or alternatively, the vertical vibrations of the degraded wheel 204 may cause the commutator to have uneven bar-to-bar voltage, may cause a brush of the DC traction motor to have a rough contact surface, may cause a brush holder of the DC traction motor to have weakened spring pressure on the brushes, may cause one or more cables to loosen, or the like, relative to the vibrations of the healthy wheel 202. Optionally, the degraded wheel 204 may induce one or more alternative performance conditions that may cause any alternative component or system of the vehicle 102 and/or the vehicle system 100 to degrade, fail, or the like.

The one or more sensors or sensing devices 126-132 onboard and/or off-board the vehicle 102 (e.g., wayside sensors) collect or obtain sensing data of the degraded wheel 204 during operation of the vehicle 102 according to the operational conditions designated by the baseline condition. For example, the sensors 126-132 may obtain or collect data related to displacement, vibrations, speed, pressure, acceleration, geometry, or the like. The sensed data may be communicated (e.g., wirelessly or wired communication), relayed, transmitted, or the like, to the off-board hardware controller 118, to the onboard controller 124, or the like.

The locomotive control system 110 and/or the off-board controller 118 monitor the performance condition of the wheel (e.g., the wheel health) based on the operational conditions designated by the baseline conditions selected by the onboard and/or off-board controllers 124, 118. For example, the controllers 124, 118 may monitor the health of the vehicle 102, the health of one or more components or systems of the vehicle 102, or the like, by monitoring or analyzing the sensed data that is obtained by the one or more onboard or off-board sensors during operation of the vehicle 102 according to the designated baseline conditions of the vehicle 102. The controllers 124, 118, or any alternative controller, may monitor the health of the vehicle 102, on a continuous or defined interval basis. Additionally or alternatively, the wheel health may be monitored autonomously or manually by an operator onboard the vehicle system 100 or an operator of the communication system 104.

Optionally, the performance condition of the wheel may be monitored by comparing the measured parameter (e.g., load, speed, geometry, curvature, or the like) of the wheel within a frequency and/or time domain. For example, the controllers 124, 118 may compare plural data points of the sensed data of a measured parameter within a frequency domain and/or time domain in order to monitor the health of the wheel or any alternative component of the vehicle 102 or vehicle system 100.

Figure 3:
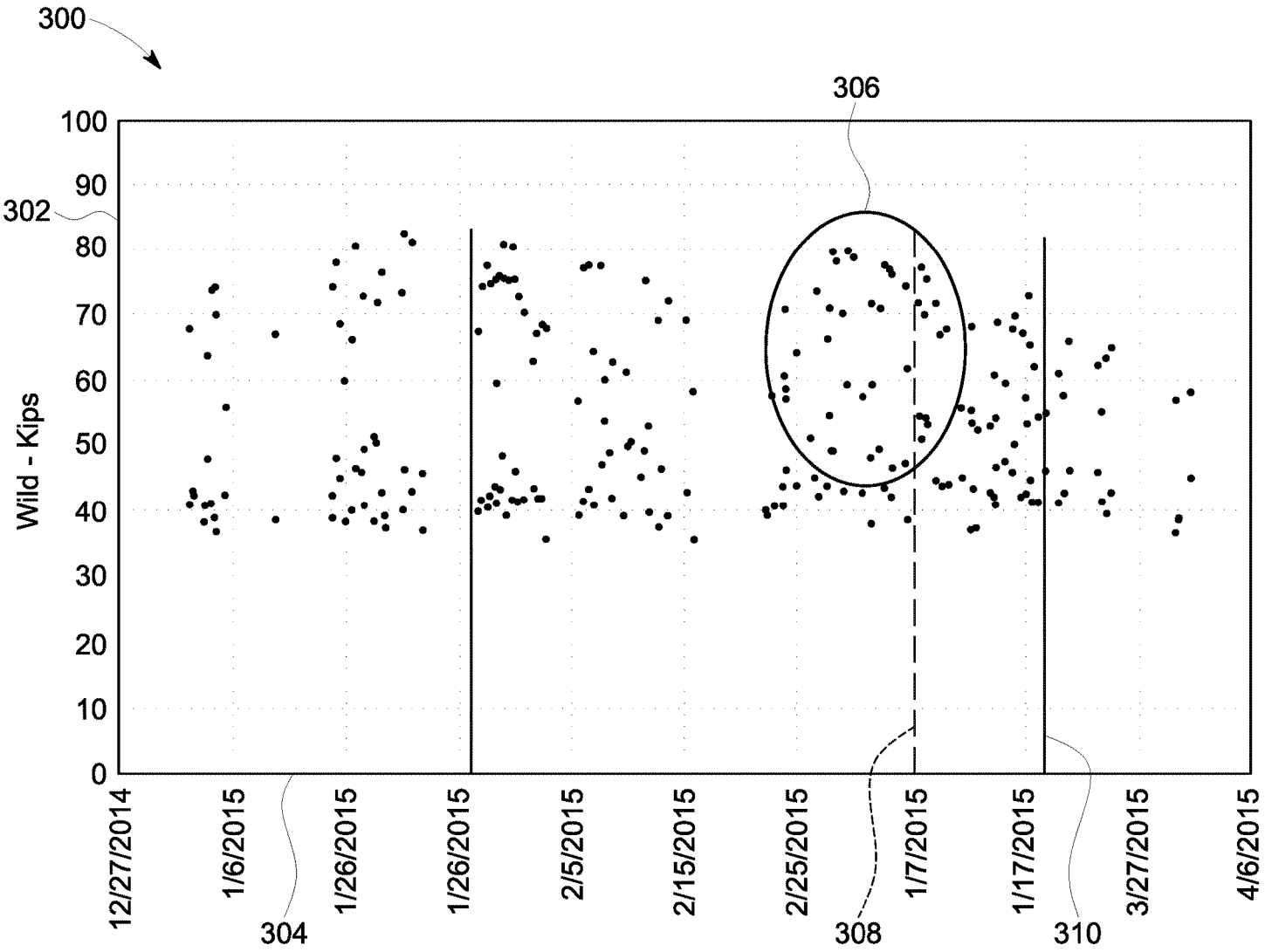
FIG. 3 illustrates a load data graph of the vehicle system of FIG. 1.

FIG. 3 illustrates a load data graph 300 of the vehicle system 100 of FIG. 1 in accordance with one embodiment. The load data of the degraded wheel 204 is shown alongside a vertical axis 302 representative of magnitudes of wayside impact load data (e.g., load data obtained or sensed by one or more wayside sensors or sensing devices) and a horizontal axis 304 representative of time. The load data graph 300 illustrates one example of identifying a flashover condition of the vehicle 102 by comparing the performance conditions that are generated by the vehicle 102 during operation of the vehicle 102 with the selected baseline conditions. Optionally, the flashover condition of the vehicle 102 may be identified by comparing the performance conditions that are generated by the vehicle 102 with one or more predefined thresholds. For example, graph 300 illustrates load data that is collected by one or more sensors or sensing devices of the degraded wheel 204 of the vehicle 102 during operation of the vehicle 102.

Optionally, the flashover condition of the vehicle 102 may be identified responsive to a variance in the performance conditions that are generated by the vehicle 102 exceeding a designated threshold. Optionally, the flashover condition may be identified by comparing the performance conditions that are generated by the vehicle 102 with one or more baseline conditions associated with at least one other vehicle. Optionally the flashover condition of the vehicle 102 may be identified responsive to identifying a method of operating one or more systems of the vehicle 102 (e.g., a plugging operation). A plugging related flashover condition will be described in more detail below.

Data points 306 illustrate one example of the wayside impact load data exceeding a predefined threshold. For example, at points 306, the load data of the degraded wheel 204 that is obtained or sensed by the wayside sensor is greater than a predefined threshold load data limit for the wheel. The controllers 124 and/or 118 may identify that the data points 306 exceed the predefined threshold and may identify a flashover condition of the vehicle 102 at the data points 306. For example, the increasing load data at the data points 306 over time may identify increasing magnitude of vibrations caused by the degraded wheel 204 as the vehicle travels along the route 114. The increasing vibrations may cause arcing in the brush and commutator interface of the direct current (DC) traction motor of the propulsions system 112 configured to provide tractive effort for propelling the vehicle 102. The arcing in the brush and commutator interface of the DC traction motor may lead to a flashover condition (e.g., an electrical spark or electrical flash). The flashover condition may damage or degrade one or more components of the DC traction motor which may require a responsive action to be implemented.

The controllers 124, 118 may determine a responsive action to implement based on the degraded components of the vehicle 102 that are identified. For example, the responsive action may include cutting off power to the DC traction motor, repairing the degraded wheel 204, replacing the degraded wheel 204, braking the vehicle 102, or the like. In one or more embodiments, the vehicle 102 may include one or more degraded wheels 204 operably coupled with one or more axles of the vehicle 102. The responsive action may include intermittently switching the power that is supplied to the one or more axles in order to share the tractive effort for propelling the vehicle 102. A vertical line 308 illustrates one example of implementing a responsive action that includes cutting the power that is supplied to the DC traction motor in response to identifying the flashover condition at data points 306. Alternatively, a vertical line 310 represents a flashover in the traction motor that is caused by the degraded wheel 204 responsive to the responsive action of cutting off the power that is supplied to the DC traction motor not being implemented. For example, line 310 illustrates the moment in time a flashover caused by wheel degradation has occurred responsive to no responsive action being implemented.

Figure 4:
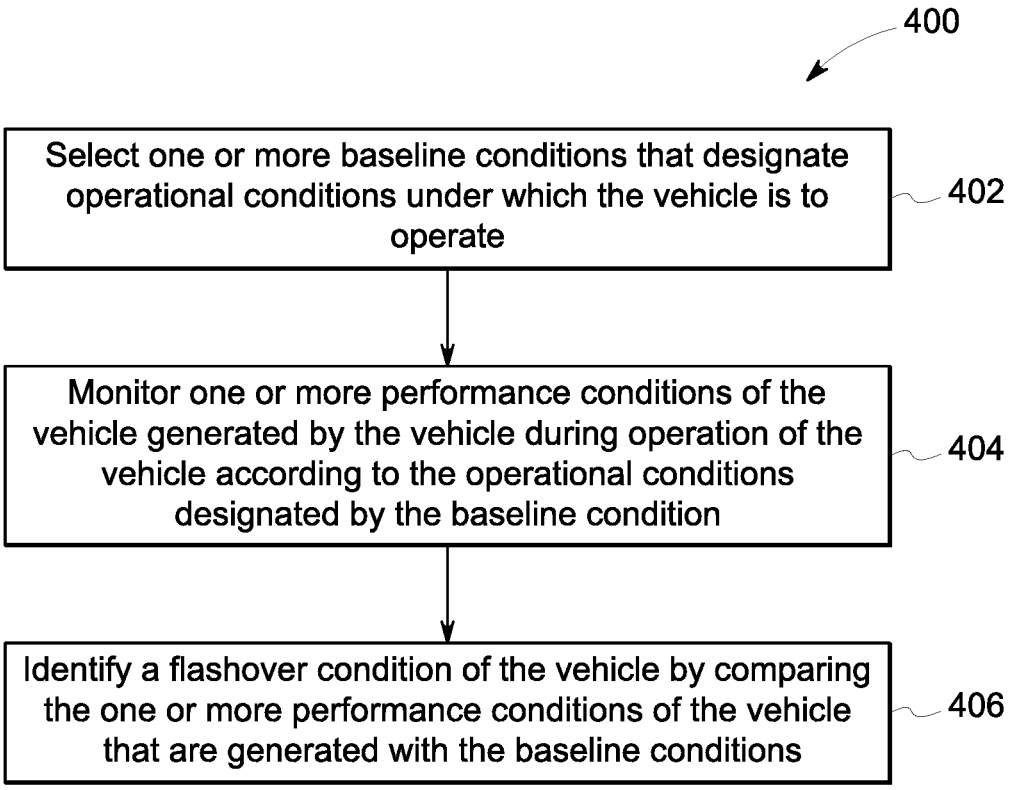
FIG. 4 a flowchart of one embodiment of a method for determining a flashover condition related to wheel degradation.

FIG. 4 illustrates a flowchart 400 of one embodiment of a method for determining a flashover condition related to wheel degradation or defects. At 402, the onboard or off-board controllers 124, 118 select one or more baseline conditions for a vehicle that designates the operational conditions under which the vehicle is to operate. The baseline conditions may include one or more baseline conditions for the wheels of the vehicle 102, the propulsion system of the vehicle 102, or any alternative component or system of the vehicle 102. For example, the baseline conditions of the wheel designate the optimal state of the wheel during operation of the wheel and may include a designated wheel shape, size, profile, magnitude of vibrations, wheel impact forces, optical wheel wear thresholds, or the like.

At 404, the controllers 110, 118 monitor one or more performance conditions of the vehicle 102 that are generated by the vehicle 102 during operation of the vehicle 102. For example, the controllers 124, 118 may monitor the data that is sensed, collected, obtained, or the like, by one or more sensors or sensing devices 126-132 onboard and/or off-board the vehicle 102 during operation of the vehicle. For example, the performance conditions that are monitored may include the wheel shape, size, and/or profile over time, changing magnitudes of vibrations, changing wheel impact forces on the track of the route 114, changing wheel wear, or the like.

At 406, a flashover condition of the vehicle 102 is identified by comparing the performance conditions of the vehicle during operation of the vehicle 102 with the baseline conditions. The flashover condition may be identified based on the performance conditions outside of a predefined threshold limit (e.g., having a measured value that is greater than or less than a predefined threshold limit) or a predefined threshold range based on the baseline conditions of the wheel. For example, the baseline condition of the wheel may include a wheel impact force of 45 KIPS (e.g., 4500 pounds-force), and the threshold limit of the wheel impact force may be 80 KIPS. During operation of the vehicle 102, a wayside load sensor may measure a degraded wheel 204 having a wheel impact force of 82 KIPS, that is greater than the threshold limit of 80 KIPS. The controllers 124, 118 may identify a flashover condition related to the degraded wheel 204 based on the measured wheel impact force of the degraded wheel 204 exceeding the 80 KIPS threshold limit. Optionally, the flashover condition may be identified based on any alternative degraded performance of the wheel, of any alternative degraded component of the propulsion system 112, of any alternative degraded component of the vehicle 102, or the like.

Optionally, the flashover condition of the vehicle 102 may be identified responsive to a variance in the performance conditions that are generated by the vehicle 102 exceeding a designated threshold. For example, the baseline conditions of the wheel may include a wheel profile variance designated threshold. The controllers 124, 118 may identify a flashover condition responsive to the wheel profile (e.g., shape, size, curvature, or the like) measuring or performing outside of the wheel profile variance designated threshold. Optionally, the flashover condition may be identified by comparing the performance conditions that are generated by the vehicle 102 with one or more baseline conditions associated with at least one other vehicle. For example, the other vehicle may be a designated healthy vehicle, may be a fleet of vehicles, may be a designated fleet of vehicles included in the vehicle system 100, may be a designated fleet of vehicles not included in the vehicle system 100, or the like.

Optionally, a responsive action may be implemented based on the degraded wheel 204 of the vehicle 102 that is identified or based on any alternative degraded component of the vehicle 102 that may be identified. The responsive action may include repairing the degraded component, replacing the degraded component, cutting off the power that is supplied to the traction motor that is operably coupled with the degraded component, braking the vehicle 102, or the like. The controllers 124, 118 may autonomously determine and/or implement the responsive action, an operator onboard the vehicle 102 may manually determine and/or implement the responsive action, an operator off-board the vehicle 102 (e.g., an operator of the communication system 104) may manually determine and/or implement the responsive action, or the like.

Figure 5:
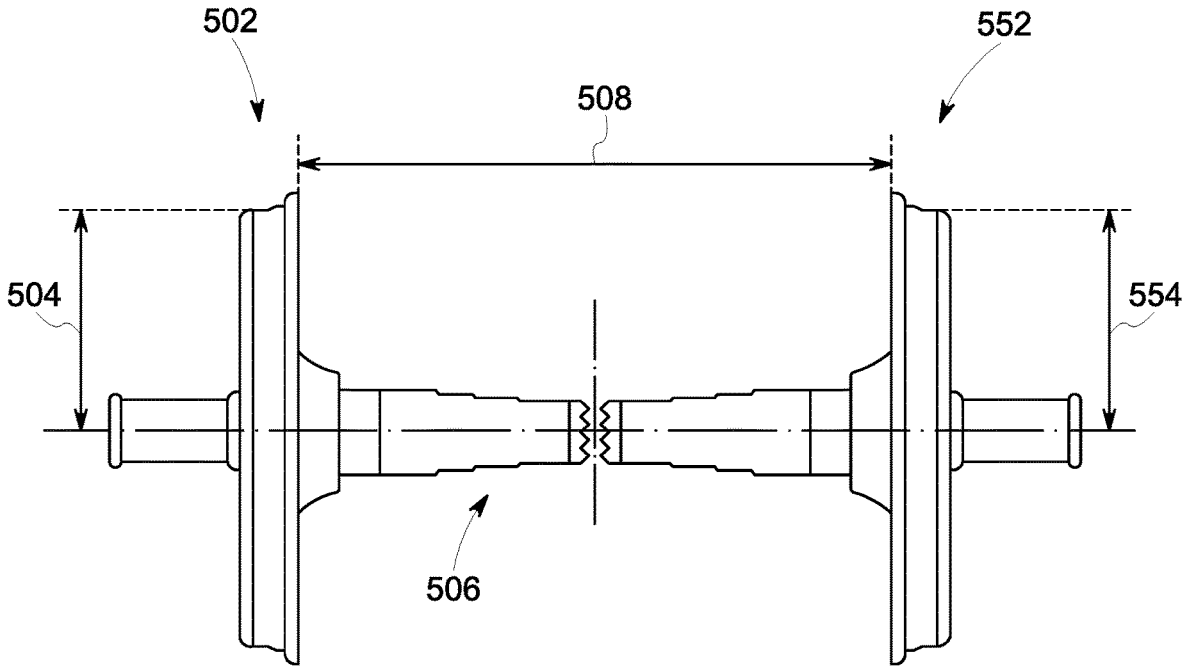
FIG. 5 illustrates a cross-sectional view of two wheels of the vehicle system.
Figure 6:
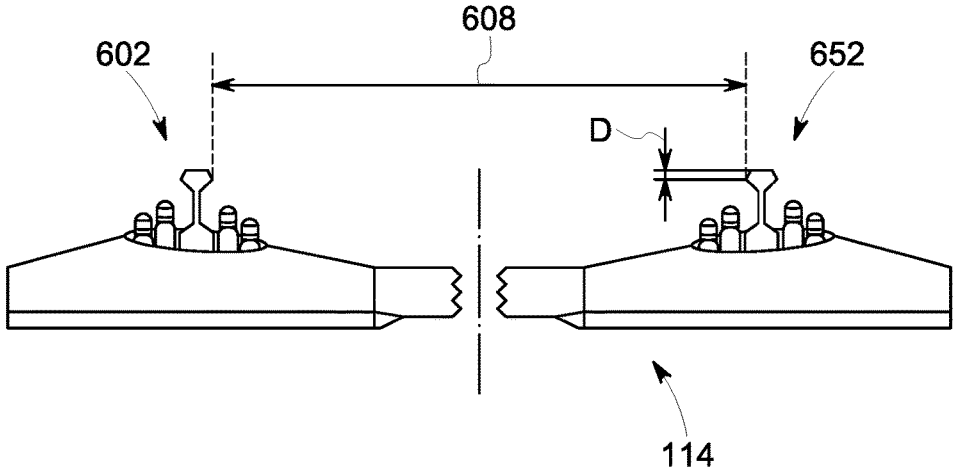
FIG. 6 illustrates a cross-sectional view of a track.

In one or more embodiments, a degraded wheel may be identified by comparing performance conditions that are generated by the wheel during operation of the vehicle with baseline conditions that designate operational conditions under which the wheel is to operate. In one example, FIG. 5 illustrates a cross-sectional front view of two wheels 502, 552 operably coupled with an axle 506 of the vehicle 102 and FIG. 6 illustrates a cross-sectional front view of tracks on which the two wheels of FIG. 5 are configured to operate. FIGS. 5 and 6 will be discussed in detail together.

The left wheel 502 and the right wheel 552 are operably coupled with the axle 506 that extends a length 508 between the left and right wheels 502, 552. The left wheel 502 includes a left wheel radius 504 and the right wheel includes a right wheel radius 554 that is substantially the same as the left wheel radius 504. The wheels 502, 552 operate on the route 114 having a left track 602 and a right track 652 that are separated by a distance 608. For example, the length 508 of the axle 506 between the left and right wheels 502, 552 allow the left wheel 502 to be operably coupled with the corresponding left track 602 and allow the right wheel 552 to be operably coupled with the corresponding right track 652 as the left and right wheels 502, 552 rotate together about the axle 506.

The controllers 124, 118 select one or more baseline conditions of the wheels 502, 552 that designate operations conditions under which the wheels 502, 552 are to operate. For example, the baseline conditions may include wheel force or wheel load impact on the tracks, wheel load location on the tracks, speed variation between the left wheel 502 and the right wheel 552, optical imaging of the wheels, wheel geometry or profile (e.g., shape, size, curvature, or the like), or the like.

The sensors or sensing devices 126-132 onboard and/or off-board the vehicle 102 (e.g., wayside sensors, cameras, GPS systems, or the like) obtain, collect, or measure, the conditions of the wheels during operation of the vehicle 102. For example, the sensors may obtain or collect data related to displacement, vibrations, speed, pressure, acceleration, geometry, or the like. The sensed data may be communicated (e.g., wirelessly or wired communication), relayed, transmitted, or the like, to the off-board controller 118, to the onboard controller 124, or the like.

The onboard controller 124 and/or the off-board controller 118 monitor the performance condition of the wheel (e.g., the wheel health) based on the operational conditions designated by the baseline conditions selected by the onboard and/or off-board controllers 124, 118. For example, the controllers 124, 118 may monitor the health of the left and right wheels 502, 552 by monitoring and/or analyzing the sensed data that is obtained by the one or more onboard and/or off-board sensors 126-132 during operation of the vehicle 102 according to the designated baseline conditions of the vehicle 102. The controllers 124, 118, or any alternative controller, may monitor the health of the vehicle 102 on a continuous or defined interval basis. Additionally or alternatively, the wheel health may be monitored autonomously or manually by an operator onboard the vehicle system 100 or an operator at the communication system 104.

Optionally, the health of the wheels 502, 552 may be monitored by comparing the measured parameter (e.g., load, speed, geometry, curvature, or the like) of the wheels 502, 552 within a frequency and/or time domain. For example, the controllers 124, 118 may compare plural data points of the sensed data of a measured parameter within a frequency domain (e.g., every kilometer, every 5 kilometers, every 500 kilometers, or the like) and/or time domain (e.g., every hour, every 5 hours, every 50 hours, or the like) in order to monitor the health of the wheels 502, 552.

In one or more embodiments, the controllers 124, 118 may monitor the health of the wheels 502, 552 (e.g., degradation, wear, or the like) by monitoring over time a wheel rolling radius of each of the wheels 502, 552 connected to the axle 506. The wheel rolling radius identifies the difference between the baseline condition of the radii 504, 554 of the left and right wheels 502, 552 as the wheels 502, 552 rotate together about the axle 506 and roll along the route 114. For example, wheel degradation, wear, defects, or the like, may cause the wheel rolling radius of one or more of the wheels 502, 552 to change as the wheels 502, 552 operate.

The controllers 124, 118 may monitor the wheel rolling radius of each wheel and a change in a load or pressure location of each wheel 502, 552 on each track 602, 652 as the wheels operate together and rotate about the axle 506 in order to identify a degraded wheel. Additionally, the baseline condition may include a wheel radius threshold, and the controllers 124, 118 may identify a degraded wheel by comparing the wheel rolling radius of each wheel 502, 552 with the wheel radius threshold.

Figure 7:
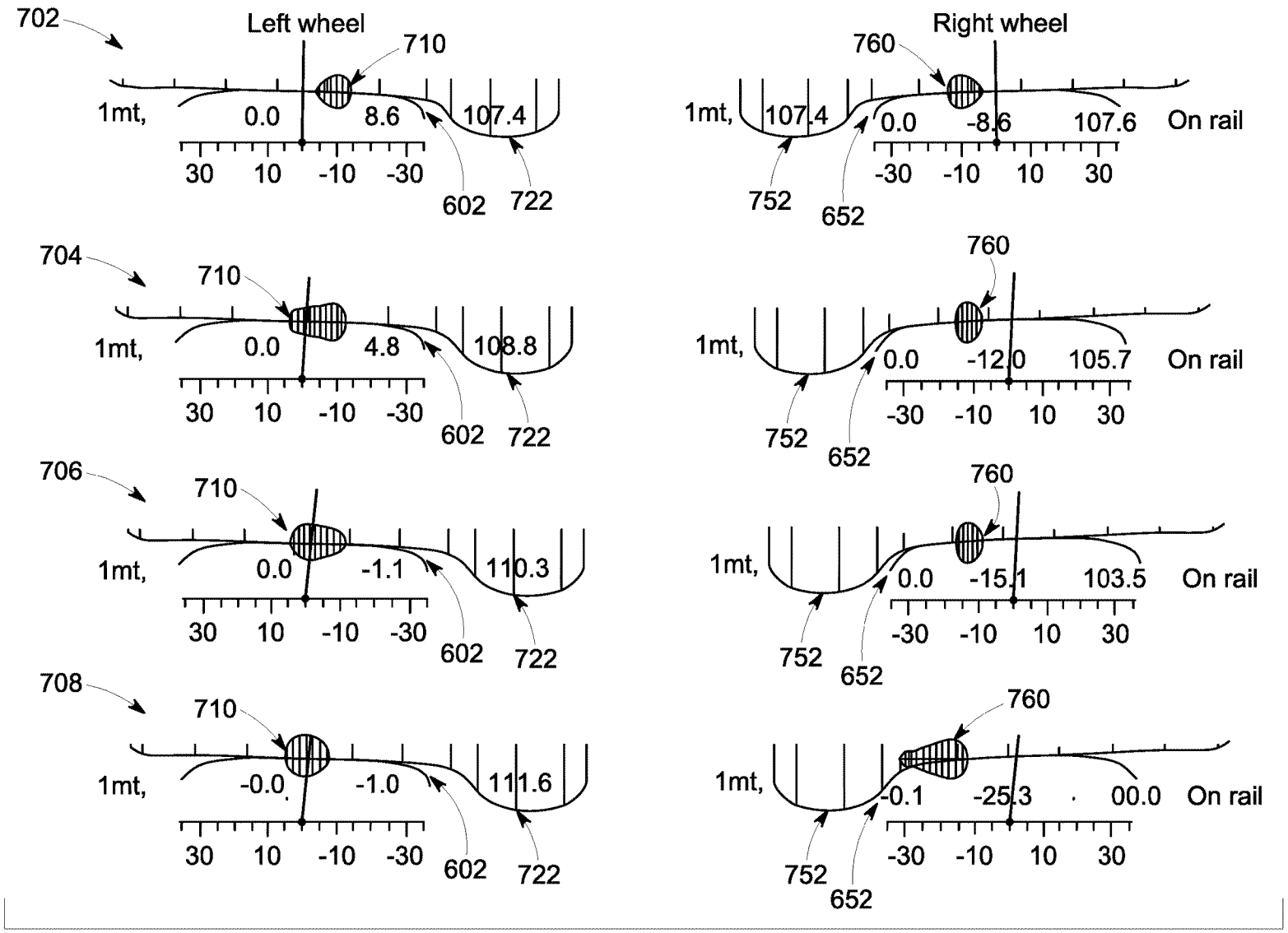
FIG. 7 illustrates examples of wheel rolling radius references and measured wheel rolling radii.

FIG. 7 illustrates four examples 702, 704, 706, and 708 of monitoring the health of the wheels 502, 552 by monitoring the rolling radius of each wheel 502, 552 connected to the axle 506 (of FIG. 5) to identify a degraded wheel of the vehicle 102. For example, one of the wheels 502, 552 operably coupled together by the axle 506 may degrade or wear. Responsive to the wheel degrading, the load on the track produced by the other, second wheel may move. The four examples illustrate the movement of the loads on the left and right tracks 602, 652 responsive to one or more of the wheels 502, 552 degrading. In the four illustrated examples, the left wheel 502 includes a left flange 722 that rotates alongside the left track 602 and is disposed between the left track 602 and the right track 652. Additionally, the right wheel 552 includes a right flange 752 that rotates alongside the right track 652 and is disposed between the left track 602 and the right track 652.

A left load 710 that is measured or sensed by the sensors or sensing devices identifies a location on the left track 602 where the left wheel 502 applies the largest pressure as the wheel 502 rotates relative to an alternative location on the left track 602. Additionally, a right load 760 that is measured or sensed by the sensors or sensing devices identifies a location on the right track 652 where the right wheel 552 applies the largest pressure as the wheel 552 rotates relative to an alternative location on the right track 652. For example, as the left and right wheels 502, 552 rotate together about the axle 506, the largest pressure point applied by each wheel onto each track is measured. The examples 702 through 708 illustrate that a change in a rolling radius of one or more of the wheels 502, 552 identifies one or more degraded wheels.

The first example 702 illustrates one example of no change in rolling radii between the left and right wheels 502, 552. For example, the left load 710 by the left wheel 502 on the left track 602 is substantially mirrored with the right load 760 by the right wheel 552 on the right track 652 about an axle center location. Additionally, the left flange 722 is disposed a distance away from the left track 602 that is substantially the same as a distance away the right flange 752 is from the right track 652.

The second example 704 illustrates one example of the right wheel 552 having a rolling radius that is less than the left wheel 502 rolling radius by 1 millimeter (mm). For example, the left flange 722 is disposed a distance away from the left track 602 that is greater than a distance away the right flange 752 is from the right track 652. Additionally, the right flange 752 does not interfere with the right track 652, and the right load 760 does not interfere with the right flange 752.

The third example 706 illustrates one example of the right wheel 552 having a rolling radius that is less that the left wheel 502 rolling radius by 2 mm. For example, the left flange 722 is disposed a distance away from the left track 602 that is greater than a distance away the right flange 752 is from the right track 652. Additionally, the right flange 752 does not interfere with the right track 652, and the right load 760 does not interfere with the right flange 752.

The fourth example 708 illustrates one example of the right wheel 552 having a rolling radius that is less than the left wheel 502 rolling radius by 3 mm. For example, the left flange 722 is disposed a distance away from the left track 602 that is greater than a distance away the right flange 752 is from the right track 652. In the fourth example 708, the right flange 752 interferes with the right track 652, and the right load 760 interferes with the right flange 752. The interference between the right flange 752 and the right track 652, and the interference between the right load 760 and the right flange 752 identifies a degraded wheel.

In one or more embodiments, a difference between the rolling radius of the right wheel 552 and the rolling radius of the left wheel 502 that is greater than 1 mm may begin or initiate contact between the track and the wheel flange. Additionally, a difference between the rolling radius of the right wheel 552 and the rolling radius of the left wheel 502 that is greater than 3 mm may cause or create interference between the track and the wheel flange. For example, the wheel may degrade or wear responsive to interference between the track and the wheel flange.

Figure 8:
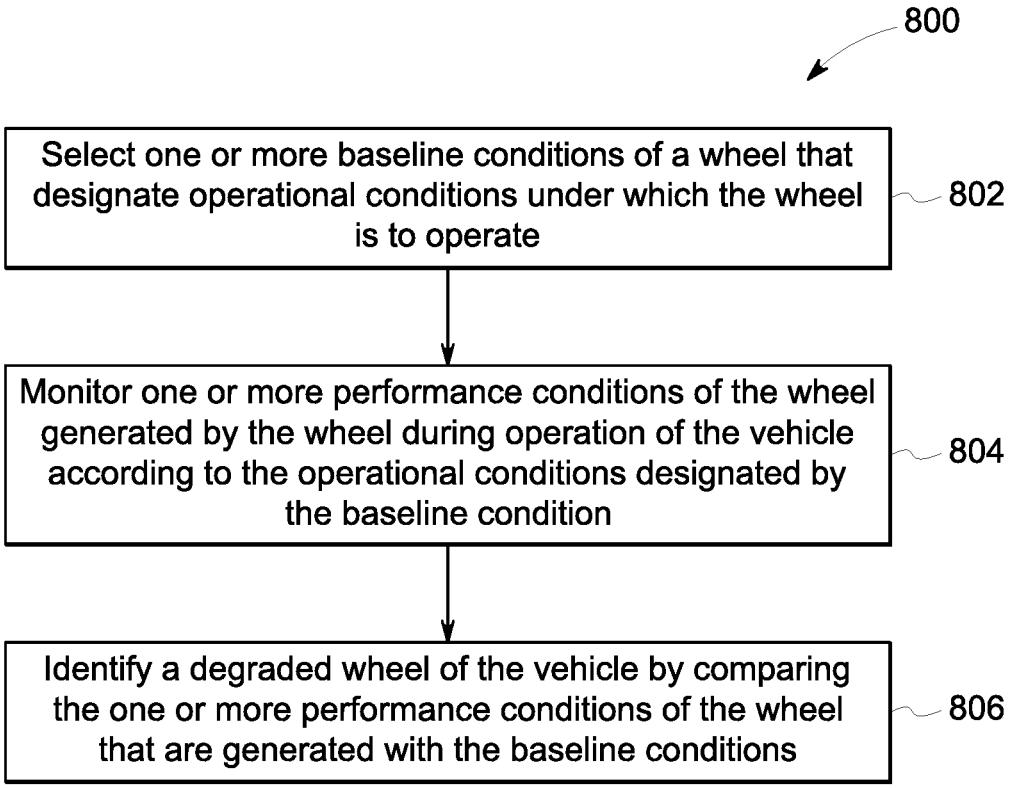
FIG. 8 illustrates a flowchart of one embodiment of a method for evaluating wheel degradation.

FIG. 8 illustrates a flowchart 800 of one embodiment of a method for determining wheel degradation. At 802, the onboard or off-board controllers 124, 118 select one or more baseline conditions of a wheel that designate operational conditions under which the wheel is to operate with the vehicle 102. For example, the baseline conditions may include a wheel radius, a designated wheel shape, size, profile, curvature, magnitude of vibrations, wheel impact force thresholds, impact force locations, optical wheel wear thresholds, or the like. The baseline conditions for the wheel designate the optimal state of the wheel during operation of the wheel.

At 804, the controllers 124, 118 monitor one or more performance conditions of the wheel that are generated by the wheel during operation of the vehicle 102. For example, the controllers 124, 118 may monitor the data that is sensed, collected, obtained, or the like, by the one or more sensors or sensing devices 126-132 onboard and/or off-board the vehicle 102 during operation of the vehicle 102. For example, the performance conditions that are monitored may include the wheel shape, a location of a wheel flange, a location of the wheel flange radius, a location of a wheel load on the track, changing wheel impact forces on the track, or the like.

At 806, a degraded wheel of the vehicle 102 is identified by comparing the performance conditions of the wheel during operation of the vehicle 102 with the baseline conditions of the wheel. The degraded wheel may be identified by determining that a variance in the performance conditions exceeds a predefined threshold limit (e.g., having a measured value that is greater than or less than a predefined threshold limit) based on the baseline conditions of the wheel. For example, the baseline conditions of the wheel may include a predetermined wheel radius. Additionally, the baseline conditions of the wheel may include a wheel radius threshold of 2 millimeters. During operation of the vehicle 102, the controllers 124, 118 may identify that the left wheel 502 has a rolling wheel radius that is 3 mm less than the baseline wheel radius of the left wheel 502. For example, the variance of the rolling wheel radius (e.g., 3 mm) exceeds the wheel radius threshold (e.g., 2 mm). The controllers 124, 118 may identify a degraded wheel based on the rolling wheel radius exceeding the wheel radius threshold. Optionally, the degraded wheel condition may be identified based on any alternative degraded performance of the wheel, or any alternative degraded component of the propulsion system 112, or the like.

Optionally, the degraded wheel may be identified responsive to a measured amount of interference or variance between the wheel flange radius and the track that is outside of a threshold amount of acceptable interference. For example, as illustrated in example 708 of FIG. 7, the load 760 applied by the right wheel 552 on the track 652 is at a location that interferes with the flange radius of the right wheel flange 752 and the right track 652. For example, the pressure or load 760 of the right wheel 552 interferes with the flange radius of the right flange 752. The amount of interference may exceed a threshold amount of interference.

Optionally, the degraded wheel may be identified by comparing the performance conditions that are generated by the wheel during operation of the vehicle 102 with one or more baseline conditions associated with at least one other wheel. For example, the other wheel may be a designated healthy wheel, may be included in the vehicle 102 or vehicle system 100, may not be included in the vehicle 102 or vehicle system 10, or the like.

Optionally, a responsive action may be implemented based on the degraded wheel of the vehicle 102 that is identified. The responsive action may include repairing the degraded wheel, replacing the degraded wheel, cutting off the power that is supplied to the traction motor (e.g., an alternating current traction motor or a direct current traction motor), repairing and/or replacing an alternative degraded component, braking the vehicle 102, or the like. The controllers 124, 118 may autonomously determine and/or implement the responsive action, an operator onboard the vehicle 102 may manually determine and/or implement the responsive action, an operator off-board the vehicle 102 (e.g., an operator of the communication system 104 may manually determine and/or implement the responsive action, or the like.

Figure 9:
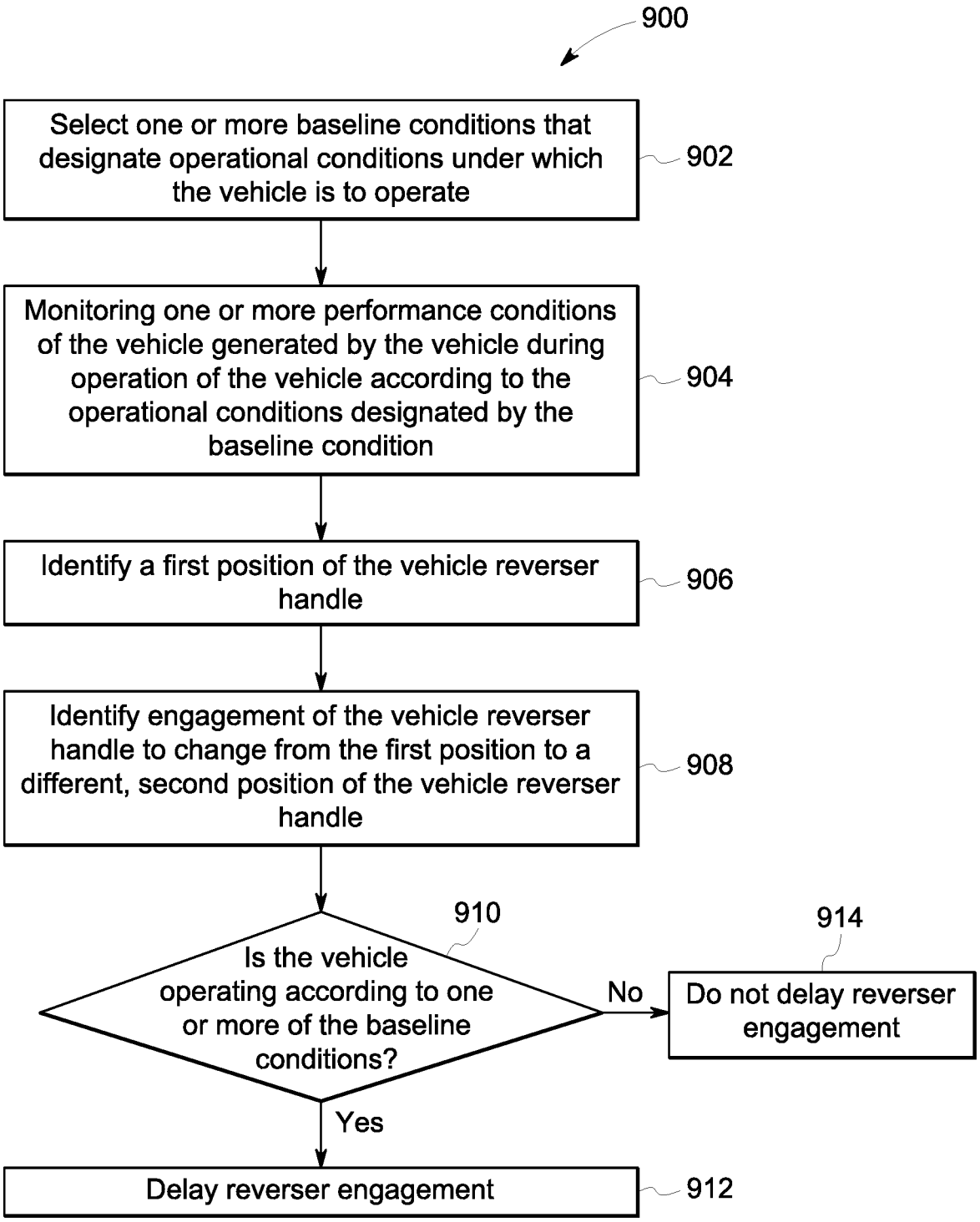
FIG. 9 illustrates a flowchart of one embodiment of a method for determining a flashover condition related to plugging.
Figure 10:
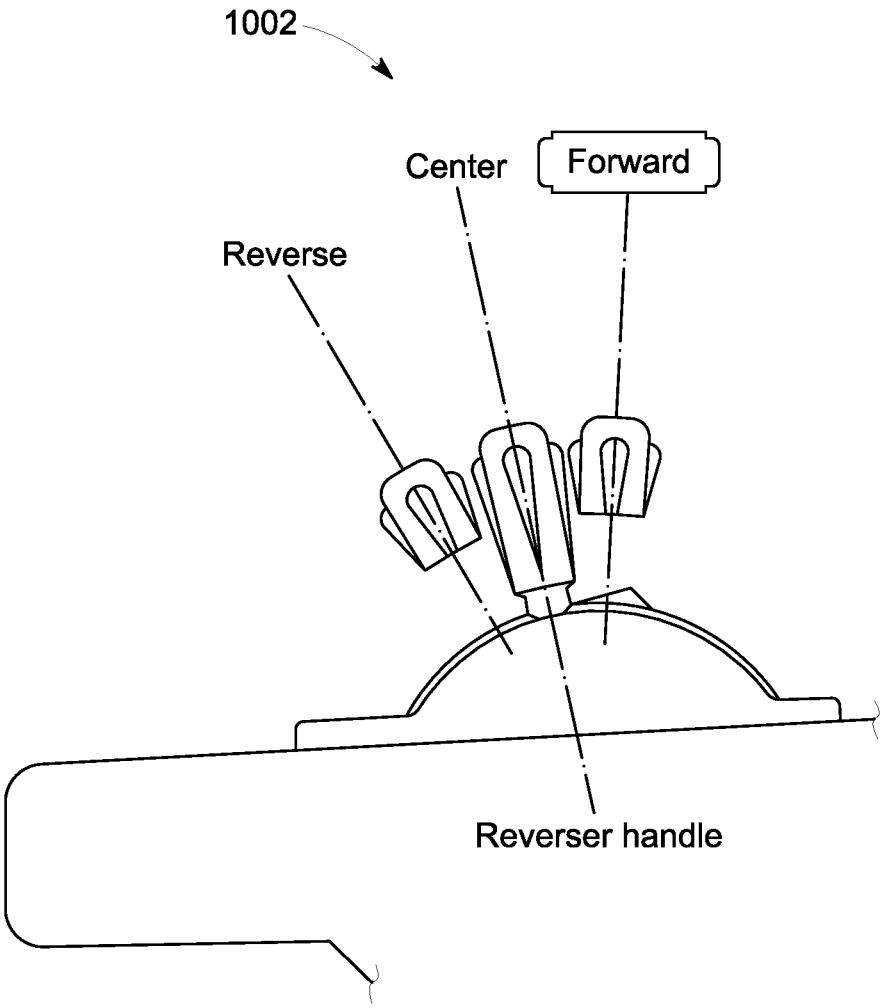
FIG. 10 illustrates a vehicle reverser handle of the vehicle system shown in FIG. 1.

Returning to the vehicle system 100 of FIG. 1, a flashover condition of the vehicle system 100 may be identified responsive to one or more operating conditions of the vehicle system 100. FIG. 9 illustrates a flowchart 900 of one embodiment of a method for determining a flashover or grounding condition related to a plugging operation. FIG. 10 illustrates a vehicle reverser handle of the vehicle 102. FIGS. 9 and 10 will be discussed in detail together.

The flowchart 900 illustrates one method for determining a flashover condition responsive to identifying that a plugging operation of controlling the traction motor of the propulsion system 112 has occurred. Plugging is a method for rapidly decelerating (e.g., brake or slow the speed of the vehicle) the traction motor by reserving the field excitation polarity of the traction motor in order to create and/or apply a counter torque to a shaft or rotor of the traction motor. For example, plugging may occur if the vehicle 102 attempts to change the direction of travel (e.g., forward to reverse, or reverse to forward) of the vehicle 102 within a predetermined length of time that may degrade or damage one or more components of a direct current (DC) traction motor. Additionally, a sporadic (e.g., occasional) or continuous reversal of motor polarity may cause damage or may degrade components of the traction motor including, but not limited to, commutators, brushes, or windings.

At 902, the onboard or off-board controllers 124, 118 select one or more baseline conditions for a vehicle 102 that designates the operational conditions under which the vehicle 102 is to operate. The baseline conditions may include one or more operating parameters including vehicle location, speed, idle duration, or a position of a vehicle reverser handle. For example, in order to identify a flashover condition related to a plugging operation the baseline conditions of the vehicle 102 may include determining a location of the vehicle and a state of the DC traction motor of the vehicle (e.g., speed, idle duration, or the like). The baseline conditions of the vehicle designate a state or condition of the vehicle 102 that may identify a plugging condition of the vehicle 102.

In one or more embodiments, the baseline conditions of the vehicle 102 for identifying a plugging operation of the vehicle 102 may include a designated location of the vehicle 102 and designated operational settings of the vehicle 102. For example, the designated locations may include a rail yard, a maintenance shed, a repair shop, or the like, and the designated operational settings may include an idle duration threshold, a speed threshold, or the like. Optionally, the baseline conditions may include any alternative condition of any system or component of the vehicle 102 during operation of the vehicle 102.

At 904, the controllers 124, 118 monitor one or more performance conditions of the vehicle 102 that are generated during operation of the vehicle 102. For example, the controllers 124, 118 may monitor the data that is sensed, collected, obtained, or the like, by one or more sensors or sensing devices 126-132 onboard and/or off-board the vehicle 102 during operation of the vehicle 102.

At 906, the controllers 124, 118 identify a first position of a vehicle reverser handle. FIG. 10 illustrates a vehicle reverser handle 1002 in accordance with one embodiment. An operator onboard the vehicle 102 controls the direction or movement of the vehicle 102 by engaging the vehicle reverser handle 1002. For example, when the vehicle 102 is traveling in a forward direction (e.g., moving in the direction a front end of the vehicle is facing) and the vehicle 102 needs to move in a reverse direction (e.g., in a direction a rear end of the vehicle is facing), the operator may engage the reverser handle 1002 in order to move the handle to the reverse position.

At 908, the controllers 124, 118 identify engagement of the vehicle reverser handle 1002 in order to change from a first position to a different, second position. For example, the controllers 124, 118 may identify that the vehicle is traveling in a forward direction (e.g., the handle is in a first position), and the operator engages the reverser handle 1002 to change the handle to a different, second position (e.g., to change direction of the vehicle to the reverse direction). Alternatively, the handle engaged in the forward direction may be referred to as the second position, and the handle engaged in the reverse direction may be referred to as the first position.

At 910, the controllers 124, 118 determine if the vehicle 102 is operating according to the one or more selected baseline conditions. In one embodiment, the baseline conditions include the designated location of a rail yard, a designated vehicle idle duration threshold, and a designated vehicle speed threshold. Additionally or alternatively, the baseline conditions may include one or more alternative conditions that designate operational conditions under which the vehicle 102 is to operate.

In one example, the vehicle 102 is at a designated location (e.g., at a rail yard, maintenance shed or the like) and the vehicle 102 is operating at a speed of 10 kilometers per hour (kph). Additionally, a maximum designated vehicle speed threshold in one example may be 5 kph. For example, the vehicle speed of 10 kph is greater than the maximum designated vehicle speed threshold (e.g., the vehicle 102 is traveling faster than the speed threshold). The controllers 124, 118 determine that the vehicle 102 is operating according to one or more of the baseline conditions, and flow of the method proceeds towards 912. Alternatively, if the controllers 124, 118 determine that the vehicle 102 is not operating according to one or more of the baseline conditions, flow of the method proceeds towards 914.

At 912, the controllers 124, 118 delay the engagement or shift of the reverser handle 1002 by the operator onboard the vehicle 102. For example, the controllers 124, 118 have identified a plugging condition of the vehicle 102 by determining that a shift of the reverser handle 1002 when the performance conditions of the vehicle 102 are different than the baseline conditions of the vehicle 102. For example, the controllers 124, 18 may delay the engagement or shift of the reverser handle 1002 in order to minimize a change in the motor current due to the reversal in the current flow through the traction motor relative to a vehicle 102 operating according to the baseline conditions.

Optionally, the controllers 124, 118 may communicate with the operator onboard the vehicle 102 or an operator off-board the vehicle 102 that engagement of the reverser handle 1002 is delayed. For example, a message may be displayed by the communication unit 108, an alarm or bell may sound, an audible message may sound, lights onboard the vehicle 102 may change (e.g., flash, dim, or the like). Optionally, the communication may continue until the vehicle 102 is operating according to the baseline conditions.

In one or more embodiments, a flashover or grounding related to a plugging operation may occur and a responsive action may be implemented. The responsive action may include repairing a degraded component, replacing a degraded component, cutting off the power that is supplied to the traction motor, braking the locomotive or vehicle 102, or the like. The controllers 124, 118 may autonomously determine and/or implement the responsive action, an operator onboard the vehicle 102 may manually determine and/or implement the responsive action, an operator off-board the vehicle 102 (e.g., an operator of the communication system 104 may manually determine and/or implement the responsive action, or the like.

Alternatively, at 914, if the vehicle 102 is not operating according to the one or more baseline conditions (e.g., the vehicle is not at a rail yard, the vehicle idle duration is greater than an idle duration threshold, and the vehicle speed is less than a vehicle speed threshold), then the controller 124 and/or 118 does not delay the engagement or shift of the reverser handle 1002 by the operator. For example, the controller 124 and/or 118 allows the operator to engage the reverser handle 1002 in order to change the position of the reverser handle 1002.

In one or more embodiments of the subject matter described herein, a locomotive control system includes a locomotive having a traction motor and one or more sensors. The traction motor provides tractive effort for propelling the locomotive. The one or more sensors measure one or more performance conditions of the locomotive. The locomotive control system also includes a controller having one or more processors communicatively coupled with the traction motor. The controller selects one or more baseline conditions that designate operational conditions under which the locomotive is to operate. The controller also monitors the one or more performance conditions that are generated by the locomotive during operation of the locomotive according to the operational conditions designated by the one or more baseline conditions. The controller is configured to identify one or more of a flashover condition or a plugging condition of the locomotive by comparing the performance conditions that are generated by the locomotive during operation of the locomotive with the one or more baseline conditions. The flashover condition or the plugging condition causing degradation of one or more components of the locomotive.

Optionally, the traction motor is a direct current electric traction motor.

Optionally, the controller is configured to identify the one or more components of the locomotive that are degraded based on the one or more of the flashover condition or the plugging condition that is identified, and determine a responsive action based on the identified one or more components of the locomotive that are degraded.

Optionally, the responsive action includes one or more of repairing the degraded component, replacing the degraded component, braking the locomotive, or cutting power to the traction motor.

Optionally, the flashover condition or the plugging condition of the locomotive is identified responsive to determining that a variance in the performance conditions that are generated by the locomotive exceeds one or more designated thresholds.

Optionally, the controller is configured to identify the one or more of the flashover condition or the plugging condition of the locomotive by comparing the performance conditions that are generated by the locomotive during operation of the locomotive with performance conditions that are generated by at least one other locomotive.

Optionally, the at least one other locomotive is a fleet of locomotives.

Optionally, the at least one other locomotive is a designated healthy locomotive.

Optionally, the controller is configured to monitor the one or more performance conditions of the locomotive generated by the locomotive during operation of the locomotive at a designated location.

Optionally, the designated location is one or more of a rail yard or a rail maintenance shed.

In one or more embodiments of the subject matter described herein, a locomotive control system includes a locomotive having a traction motor, a wheel, and one or more sensors. The traction motor provides tractive effort for propelling the locomotive. The one or more sensors measure one or more performance conditions of the wheel. The locomotive control system also includes a controller having one or more processors communicatively coupled with the traction motor. The controller selects one or more baseline conditions of the wheel that designate operational conditions under which the wheel is to operate. The controller also monitors the one or more performance conditions of the wheel generated by the wheel measured by the one or more sensors. The performance conditions are generated by the wheel during operation of the locomotive according to the operational conditions designated by the one or more baseline conditions. The controller is configured to identify a degraded wheel of the locomotive by comparing the performance conditions that are generated by the wheel during operation of the locomotive with the one or more baseline conditions.

Optionally, the controller is configured to identify one or more of a flashover condition or a plugging condition of the locomotive by comparing the one or more performance conditions that are generated by the wheel during operation of the locomotive with the one or more baseline conditions. The flashover condition or the plugging condition causing degradation of one or more components of the locomotive.

Optionally, the controller is configured to determine a responsive action to implement based on the degraded wheel of the locomotive that is identified.

Optionally, the responsive action includes one or more of repairing the degraded wheel, replacing the degraded wheel, braking the locomotive, or cutting power to the traction motor.

Optionally, the controller is configured to identify the degraded wheel of the locomotive by comparing the performance conditions with one or more baseline conditions associated with at least one other wheel.

Optionally, the at least one other wheel is a designated healthy wheel.

Optionally, the one or more performance conditions of the wheel includes a rolling radius of the wheel as the wheel rotates about an axle.

Optionally, the one or more baseline conditions includes a wheel radius threshold, wherein the controller is configured to identify the degraded wheel of the locomotive by comparing the rolling radius of the wheel with the wheel radius threshold.

In one or more embodiments of the subject matter described herein, a locomotive control system includes a locomotive having a traction motor and one or more sensors. The traction motor provides tractive effort for propelling the locomotive. The one or more sensors measure one or more performance conditions of the locomotive. The locomotive control system also includes a controller having one or more processors communicatively coupled with the traction motor. The controller selects one or more baseline conditions that designate operational conditions under which the locomotive is to operate. The controller also monitors the one or more performance conditions that are generated by the locomotive during operation of the locomotive according to the operational conditions designated by the one or more baseline conditions. The controlled is configured to identify one or more of a flashover condition or a plugging condition of the locomotive by determining a variance in the performance conditions that are generated by the locomotive during operation of the locomotive exceeds one or more designated thresholds. The flashover condition or the plugging condition causing degradation of the one or more components of the locomotive.

Optionally, the controller is configured to identify the one or more of the flashover condition or the plugging condition of the locomotive by comparing the performance conditions that are generated by the locomotive during operation of the locomotive with performance conditions that are generated by at least one other locomotive.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to those of skill in the art upon reviewing the above description. As used herein, the terms "including" and "in which" are used as the plain-English equivalents of the respective terms "comprising" and "wherein." Moreover, terms such as "first," "second," "third," "upper," "lower," "bottom," "top," etc. are used merely as labels, and are not intended to impose numerical or positional requirements on their objects.

This written description uses examples to disclose several embodiments of the inventive subject matter, including the best mode, and also to enable one of ordinary skill in the art to practice the embodiments of inventive subject matter, including making and using any devices or systems and performing any incorporated methods.

As used herein, an element or step recited in the singular and proceeded with the word "a" or "an" should be understood as not excluding plural of said elements or steps, unless such exclusion is explicitly stated. Furthermore, references to "one embodiment" of the inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the above-described system and method without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

What is claimed is:

1. A vehicle control system comprising:

one or more sensors configured to measure one or more performance conditions of a vehicle, the one or more performance conditions including wheel impact locations on a route along which the vehicle moves where a wheel of the vehicle impacts the route; and a controller having one or more processors configured to select a wheel baseline condition that designates one or more target wheel impact locations indicative of target wheel impact locations, the target wheel impact locations being target locations on the route where the wheel is expected to impact the route, the controller configured to monitor the wheel impact locations and compare the wheel impact locations with the target wheel impact locations to determine a difference between the wheel impact locations and the target wheel impact locations, wherein the controller is configured to identify a flashover condition of the vehicle based on the difference between the wheel impact locations and the target wheel impact locations exceeding a designated threshold, the flashover condition associated with degradation of one or more components of a traction motor of the vehicle.

2. The vehicle control system of claim 1, wherein the traction motor is a direct current electric traction motor.

3. The vehicle control system of claim 1, wherein the controller is configured to identify the one or more components of the traction motor of the vehicle that are degraded based on the flashover condition that is identified, and determine a responsive action based on the one or more components of the vehicle that are identified as degraded.

4. The vehicle control system of claim 3, wherein the responsive action includes one or more of repairing the degraded component, replacing the degraded component, braking the vehicle, or cutting power to the traction motor.

5. The vehicle control system of claim 1, wherein the controller is configured to identify the flashover condition of the vehicle responsive to determining that a variance in the wheel impact locations exceeds one or more designated thresholds.

6. The vehicle control system of claim 1, wherein the controller is configured to identify the flashover condition of the vehicle by comparing the wheel impact locations of the wheel of the vehicle during operation of the vehicle with one or more generated wheel impact locations that are generated by at least one other vehicle.

7. The vehicle control system of claim 6, wherein the at least one other vehicle is a vehicle fleet.

8. The vehicle control system of claim 6, wherein the at least one other vehicle is a designated healthy vehicle.

9. The vehicle control system of claim 1, wherein the controller is configured to monitor the wheel impact locations generated by the vehicle during operation of the vehicle at a designated location.

10. The vehicle control system of claim 9, wherein the designated location is one or more of a rail yard or a maintenance shed.

11. A vehicle control system comprising:

one or more sensors configured to measure wheel impact locations between a wheel and a route along which a vehicle moves; and a controller having one or more processors configured to select target wheel impact locations that designate target impact locations where the wheel of the vehicle is expected to contact the route, the controller configured to monitor the wheel impact locations measured by the one or more sensors and compare the wheel impact locations with the target wheel impact locations while the vehicle moves along a route to determine a difference between the wheel impact locations and the target wheel impact locations, wherein the controller is configured to identify a degraded wheel of the vehicle based on a difference between the wheel impact locations and the target wheel impact locations exceeding a designated threshold, and wherein the controller is configured to identify a flashover condition of the vehicle based on the identification of the degraded wheel of the vehicle, the degraded wheel associated with the flashover condition of the vehicle and degradation of one or more components of a traction motor of the vehicle.

12. The vehicle control system of claim 11, wherein the controller is configured to determine a responsive action to implement based on the degraded wheel of the vehicle that is identified.

13. The vehicle control system of claim 12, wherein the responsive action includes one or more of repairing the degraded wheel, replacing the degraded wheel, braking the vehicle, or cutting power to the traction motor.

14. The vehicle control system of claim 11, wherein the controller is configured to identify the degraded wheel of the vehicle by comparing the wheel impact locations with other wheel impact locations associated with at least one other wheel of the vehicle.

15. The vehicle control system of claim 14, wherein the at least one other wheel is a designated healthy wheel.

16. The vehicle control system of claim 11, wherein the target wheel impact locations include a location where the wheel is expected to contact the route and a target load of the wheel at the location where the wheel is expected to contact the route.

17. The vehicle control system of claim 16, wherein the controller is configured to measure an actual load of the wheel at locations along the route, and wherein the controller is configured to identify the degraded wheel of the vehicle by comparing the target load of the wheel with the measured actual load of the wheel.

* * * * *